US005285766A

United States Patent [19]

Milliman

[11] Patent Number: 5,285,766

[45] Date of Patent: Feb. 15, 1994

[54] GUN WITH REMOVABLE ROTARY AMMUNITION CLIP

[75] Inventor: Keith L. Milliman, Fairport, N.Y.

[73] Assignee: Crosman Corporation, East Bloomfield, N.Y.

[21] Appl. No.: 921,727

[22] Filed: Jul. 30, 1992

[51] Int. Cl.[5] ..... F41B 11/02; F41B 11/06

[52] U.S. Cl. ..... 124/72; 124/48; 124/71; 124/74

[58] Field of Search ..... 124/56, 63, 70–74, 124/76, 82, 83, 45, 48, 66, 67; 42/59, 60, 89

[56] References Cited

U.S. PATENT DOCUMENTS

| | | | |
|---|---|---|---|
| 211,743 | 1/1879 | Joslyn . | |
| 373,893 | 11/1887 | Howe | 42/66 X |
| 422,930 | 3/1890 | Fox et al. | 42/66 X |
| 1,049,105 | 12/1912 | Key | 42/66 X |
| 2,150,914 | 3/1939 | Gaidos . | |
| 2,237,678 | 4/1941 | Lohr et al. | 124/44.7 X |
| 2,609,811 | 10/1952 | Lawrence | 124/48 |
| 2,980,096 | 4/1961 | Merz | 124/48 X |
| 3,212,489 | 10/1965 | Merz | 124/48 X |
| 3,219,023 | 11/1965 | Ryan | 124/83 |
| 3,726,266 | 4/1973 | Palmer . | |
| 3,741,189 | 6/1973 | Kester et al. | 124/48 X |
| 3,766,903 | 10/1973 | Fischer | 124/44.7 X |
| 3,782,359 | 1/1974 | Kester et al. | 124/48 |
| 3,913,553 | 10/1975 | Braughler et al. | 124/48 X |
| 4,038,961 | 8/1977 | Olofsson | 124/69 |
| 4,422,433 | 12/1983 | Milliman | 124/74 |
| 4,610,382 | 9/1986 | Ollivier et al. | 42/89 X |
| 4,848,307 | 7/1989 | Tsao | 124/59 |
| 4,986,251 | 1/1991 | Lilley | 124/67 |
| 5,160,795 | 11/1992 | Milliman | 42/65 |

FOREIGN PATENT DOCUMENTS

| | | | |
|---|---|---|---|
| 2244121 | 11/1991 | United Kingdom | 124/72 |

*Primary Examiner*—Randolph A. Reese
*Assistant Examiner*—John Ricci

[57] ABSTRACT

A gun is provided with a removable rotary ammunition clip assembly and a slidably mounted barrel to permit the clip assembly to be removed if a pellet jams in a position partially out of the clip and partially in the barrel. The clip assembly is an integral unit and includes a cylindrical loader which is rotatably mounted on the clip housing, an index lever and pawl for rotating the loader, and a transfer bar for translating sliding movement of the trigger into pivoting movement of the index lever. Sliding movement of the trigger moves the trigger link against a hammer for cocking the hammer, and the trigger link moves a hammer latch out of a latching position in which it will engage the hammer to prevent accidental discharge.

18 Claims, 8 Drawing Sheets

GUN WITH REMOVABLE ROTARY AMMUNITION CLIP

BACKGROUND

This invention relates to guns, and, more particularly, to a gun which is provided with a removable rotary ammunition clip and a sliable barrel.

Pellet guns which are powered by pressurized air or $CO_2$ gas have been designed with removable rotary ammunition clips. Prior gun designs, have not, however, addressed the problem of clip removal when a pellet jams partially out of the clip and partially into the barrel. Such an occurrence effectively "locks" the clip into the gun. The user finds it difficult to remedy the problem without disassembling the gun or using sufficient force to "shear" the pellet into two pieces. Clip jamming may be less likely in a gun which has a pivoting barrel, but the use of a pivoting barrel creates other design considerations.

SUMMARY OF THE INVENTION

This invention provides a gun with a removable clip assembly which is removable even when a pellet jams between the loader and the barrel and provides several other novel features. The barrel is slidably mounted in the receiver of the gun and is movable by a barrel latch which includes tab portions which extend through both sides of the receiver. The clip assembly is an integral unit and includes a cylindrical loader which is rotatably and removably mounted on a clip housing, an index lever and pawl for rotating the loader, and a transfer bar for translating sliding movement of the trigger to pivoting movement of the index lever. Sliding movement of the trigger moves a trigger link against a hammer for cocking the hammer, and the trigger link moves a hammer latch out of a latching position in which it will engage the hammer to prevent accidental discharge.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
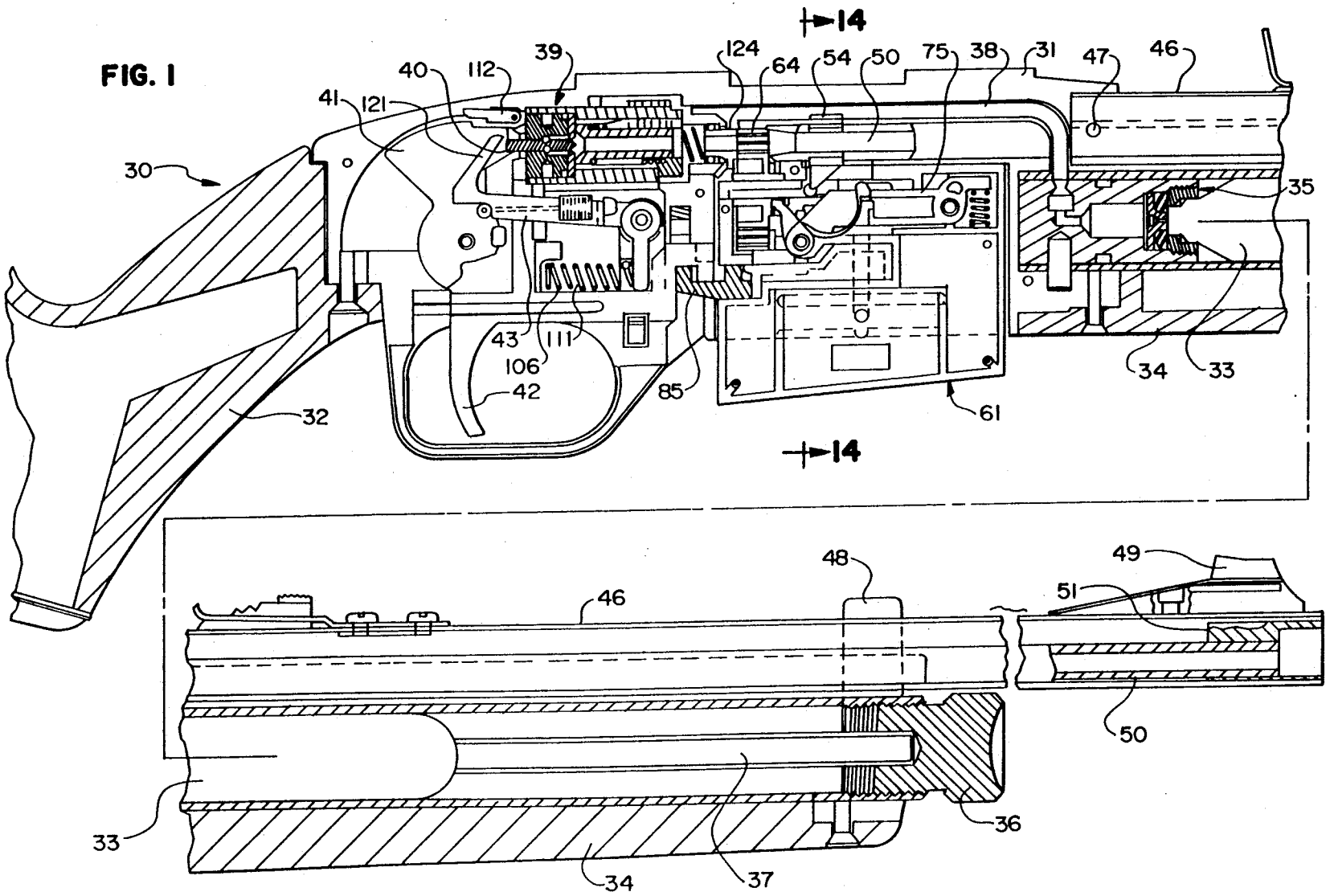
FIG. 1 is a sectional view, partially broken away, of a gun formed in accordance with the invention.

Referring first to FIG. 1, the invention will be described with respect to a rifle 30, but it will be understood that the invention can also be used in a pistol. The gun includes a frame or receiver 31 which is provided by right and left halves and a stock 32 which is secured to the receiver.

The particular gun illustrated is powered by pressurized $CO_2$ gas, but the gun can also be powered by pressurized air. A $CO_2$ cartridge 33 is mounted within a hand grip 34 which is attached to the receiver. The cartridge is held against a cartridge piercing assembly 35 by a knob 36 which is screwed into the hand grip and a rod 37. $CO_2$ flows from the piercing assembly through tube 38 to a valve assembly 39. The valve assembly 39 is conventional and is of the type which is described in U.S. Pat. No. 4,422,433 and U.S. Pat. No. 5,160,790.

A valve stem 40 extends rearwardly from the valve assembly and is engageable by a hammer 41. The hammer is operated by a trigger 42 and a trigger link 43. As will be explained more fully hereinafter, when the trigger is pulled, the hammer is pivoted to a cocked position (FIG. 5) and then released so that it strikes the valve stem 40 (FIG. 6) to move the valve stem momentarily to the right to release a charge of compressed gas to fire a projectile.

Figure 4:
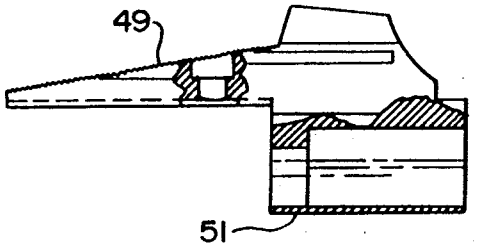
FIG. 4 is a sectional view of the forward sight.

An elongated cylindrical barrel shroud 46 is mounted on the receiver and secured by screws 47 and band 48. A sight 49 is mounted on the forward end of the shroud. A cylindrical metal barrel 50 is slidably supported by the receiver and the sight. The rear end of the barrel is slidably supported in a groove in the receiver, and the forward end of the barrel is slidably supported in a circular collar 51 (FIG. 4) which is positioned in the forward end of the shroud and which is attached to the remainder of the slot through the slot in the forward end of the shroud.

Figure 7:
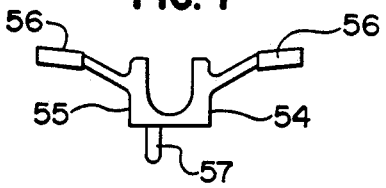
FIG. 7 is a front elevational view of the barrel latch.
Figure 8:
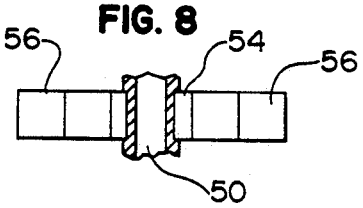
FIG. 8 is a fragmentary sectional view showing the barrel latch installed on the barrel.
Figure 9:
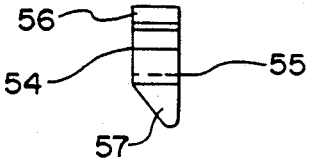
FIG. 9 is a side elevational view of the barrel latch.
Figure 21:
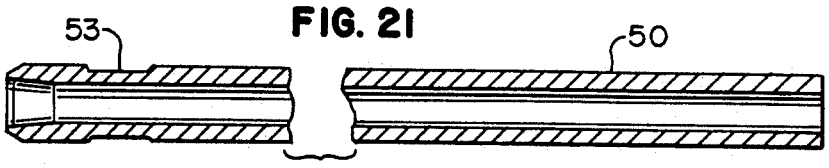
FIG. 21 is a fragmentary sectional view of the barrel.

The rear end of the barrel 50 is provided with an annular groove 53 (FIG. 21), and a plastic barrel latch 54 (FIGS. 7-9) is retained within the groove. The barrel latch includes a U-shaped body 55 which fits around the barrel, a pair of laterally extending finger tabs 56, and a downwardly extending safety tab 57.

Figure 3:
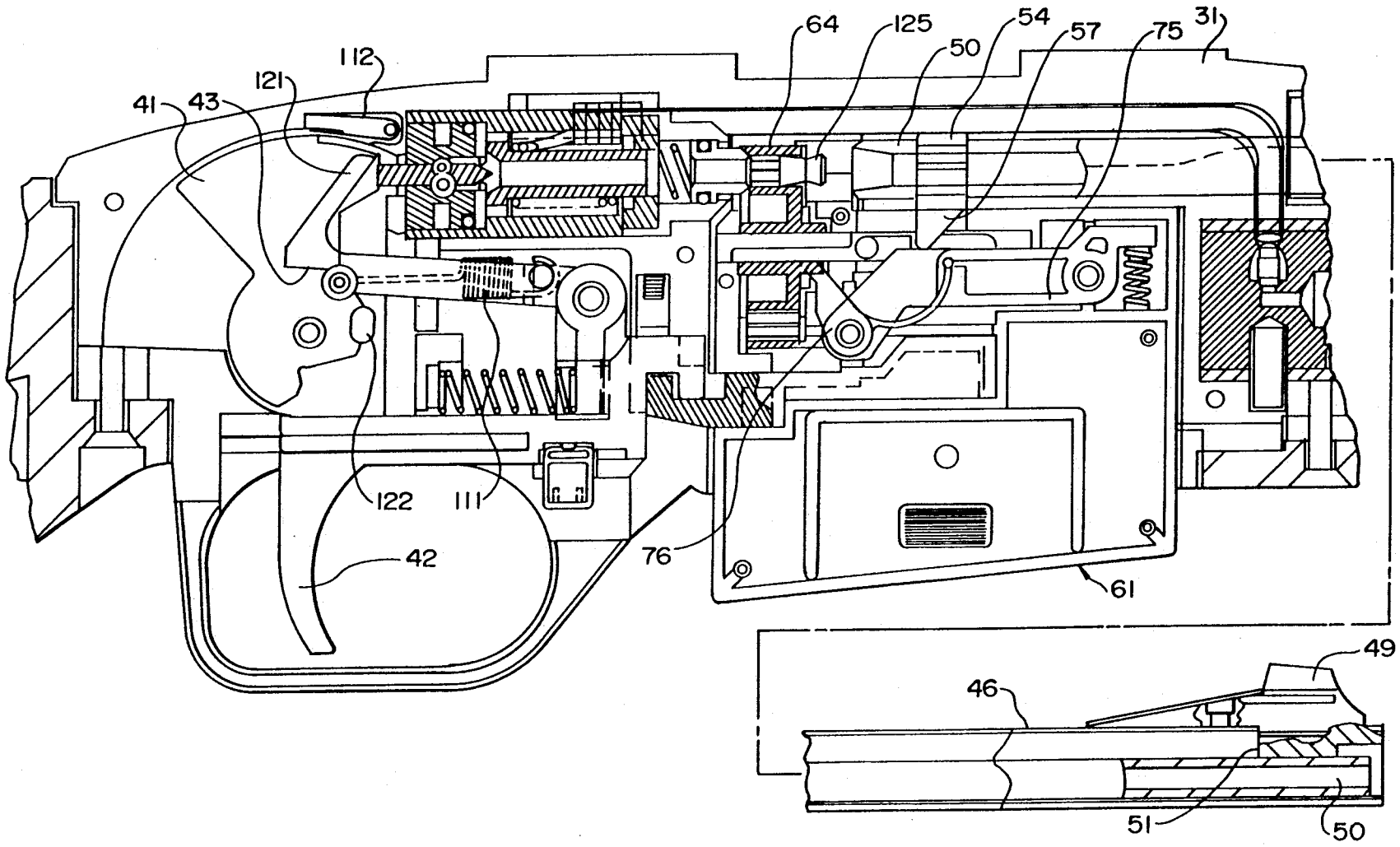
FIG. 3 is a fragmentary sectional view of the gun showing the barrel moved to its forward position.
Figure 10:
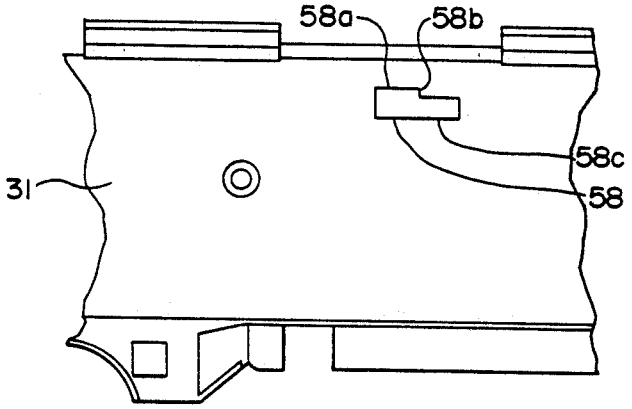
FIG. 10 is a fragmentary side elevational view of the portion of the receiver in which the clip assembly is installed.

The finger tabs 56 extend through slots 58 (FIG. 10) in the sides of the receiver. Each slot includes a latching portion 58a which terminates in a shoulder 58b and an unlatched portion 58c which extends forwardly below the shoulder parallel to the axis of the barrel. The barrel is latched in its firing position when the finger tabs 56 of the barrel latch are positioned in the latching portions 58a of the slots. The barrel can be moved forwardly within the barrel shroud by flexing the finger tabs 56 of the barrel latch below the shoulders 58b and then pushing the finger tabs forwardly. FIG. 3 shows the barrel moved to its forward position. As will be explained more fully hereinafter, the safety tab 57 on the barrel latch prevents the gun from firing when the barrel is moved out of its firing position.

Figure 12:
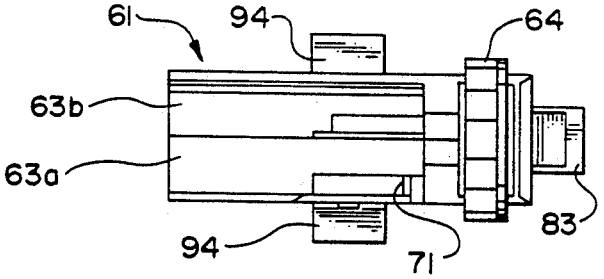
FIG. 12 is a top plan view of the clip assembly.
Figure 11:
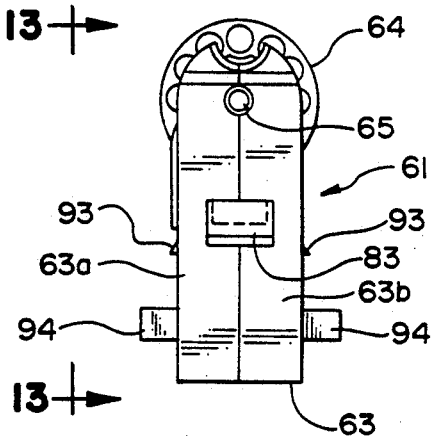
FIG. 11 is a front elevational view of the clip assembly.
Figure 13:
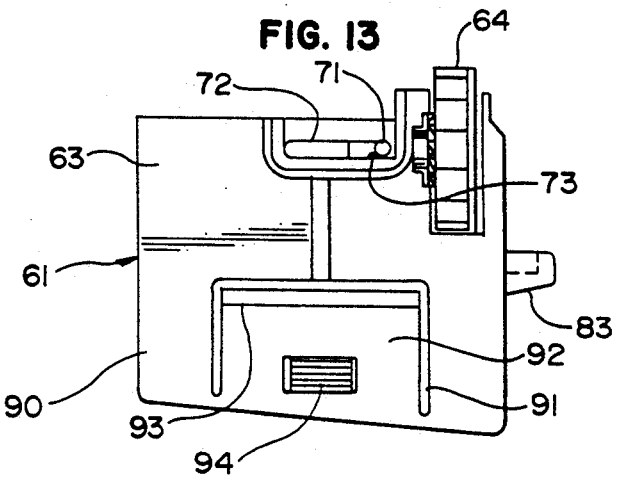
FIG. 13 is a side elevational view of the clip assembly taken along the line 13—13 of FIG. 11.

A clip assembly 61 is removably mounted in a recess 62 (FIG. 2) in the receiver. The clip assembly includes a plastic clip housing 63 (FIGS. 11–13) which is formed by right and left halves 63a and 63b. A cylindrical ammunition loader 64 is rotatably mounted in the clip housing by a plastic loader pin 65 (FIGS. 2 and 11).

Figure 16:
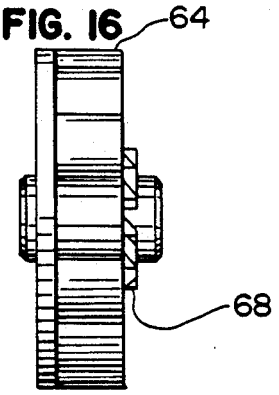
FIG. 16 is a side elevational view of the rotary loader.
Figure 17:
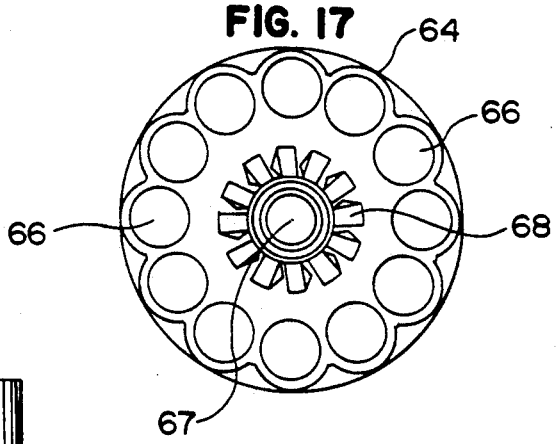
FIG. 17 is a front elevational view of the rotary loader.

Referring to FIGS. 16 and 17, the loader 64 is provided with a plurality of bores or openings 66 for receiving projectiles such as pellets and central pivot opening 67 through which the loader pin 65 extends. The front face of the loader is provided with conventional indexing ratchet teeth 68 for rotating the loader. Additional details of the ratchet teeth are described in U.S. Pat. No. 4,422,433 and U.S. application Ser. No. 737,209. The rotational axis of the loader is parallel to the axis of the barrel, and rotation of the loader brings the projectile bores into successive alignment with the barrel.

Figure 18:
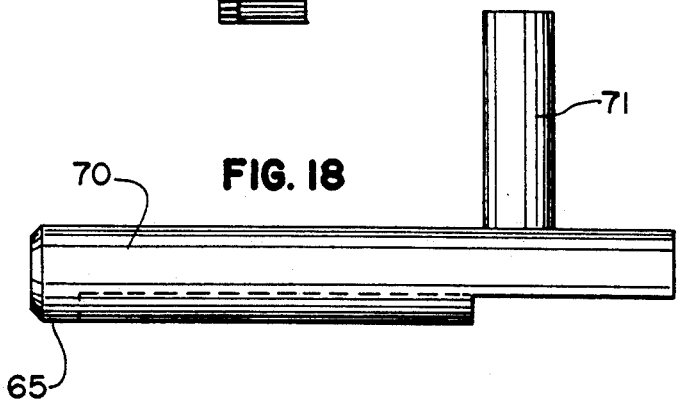
FIG. 18 is a top plan view of the loader pin.

The loader pin 65 is rotatably mounted in the clip housing and includes a cylindrical body 70 (FIG. 18) and a transversely extending finger pin 71 which extends through a slot 72 (FIG. 13) in the clip housing. The loader 64 can be removed from the clip housing by sliding the finger portion 71 to the left in FIGS. 11 and 12 to withdraw the pin body 70 from the pivot opening 67 of the loader. A detent 73 (FIGS. 13–15) is molded into the slot 72 and engages the finger pin 71 to prevent inadvertent movement of the loader pin. The loader pin can be moved by flexing the finger pin over the detent.

Figure 2:
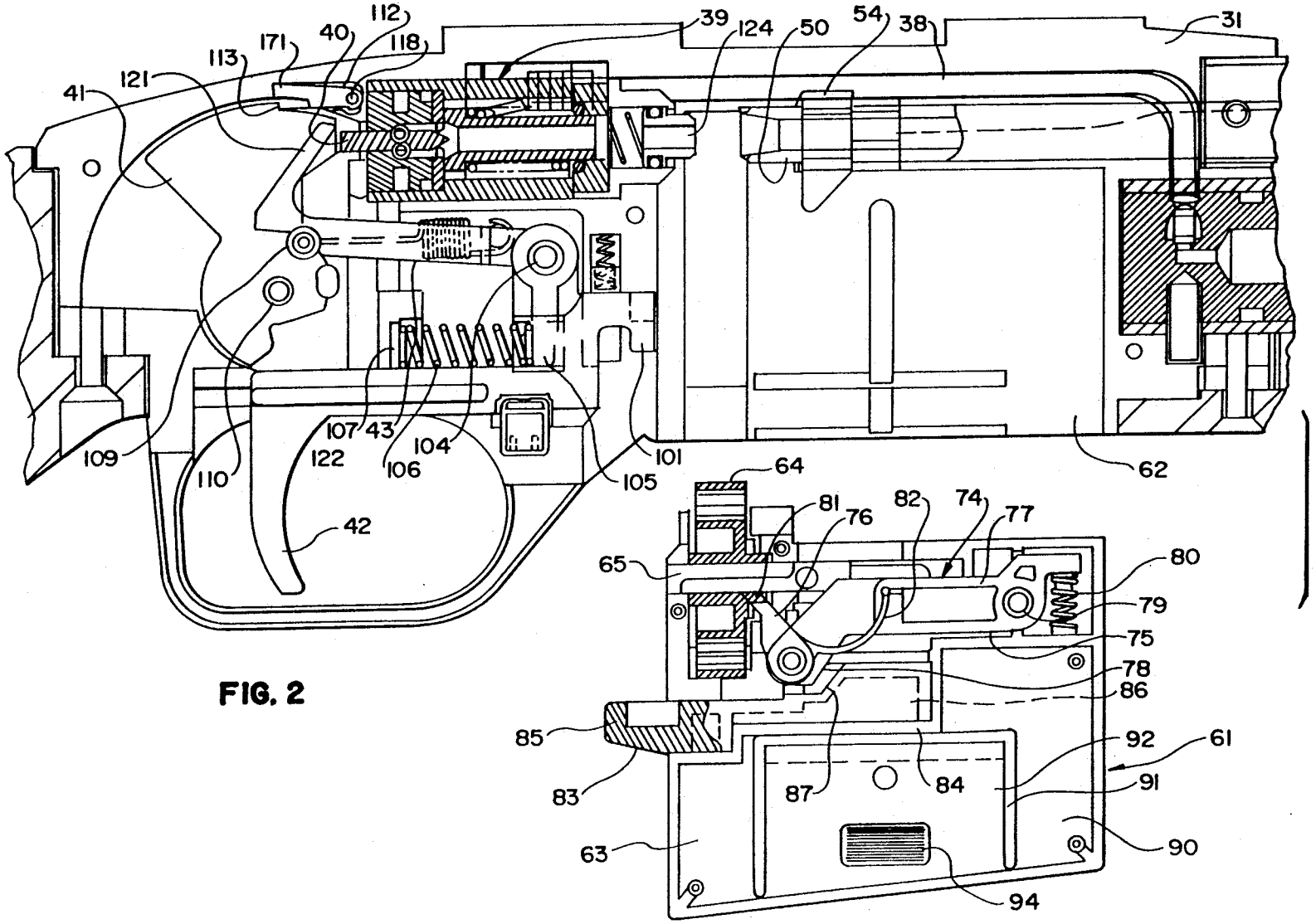
FIG. 2 is a fragmentary sectional view of the gun showing the clip assembly removed.

Referring to FIG. 2, an indexing assembly 74 within the clip housing includes an index lever 75 and an index pawl 76. The indexing assembly is similar to the indexing assembly which is described in application Ser. Nol 737,209 but is self-contained within the clip housing 63. The index lever includes a longitudinal extending forward portion 77 in a downwardly angled rear portion 78. The lever is pivotally mounted on the clip housing by a pin 79, and the lever is resiliently biased to rotate counterclockwise by an index spring 80. The lever is advantageously molded from plastic such as Black Zytel 70633.

The pawl 76 includes a ratchet-engaging point 81 and a curved spring portion 82 which is formed integrally with the remainder of the pawl. The pawl is advantageously molded from plastic such as Black Delron II 100, and the curved spring portion is flexible and resilient.

The pawl 76 is pivotally mounted on the lever 75 by a pin 83 on the rear end of the lever which extends into an opening in the pawl. The spring 82 engages a shoulder on the lever for resiliently biasing the pawl to rotate in the counterclockwise direction.

Figure 19:
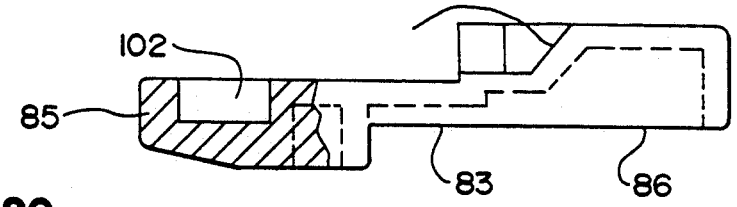
FIG. 19 is a side elevational view, partially broken away, of the transfer bar of the clip assembly.
Figure 20:
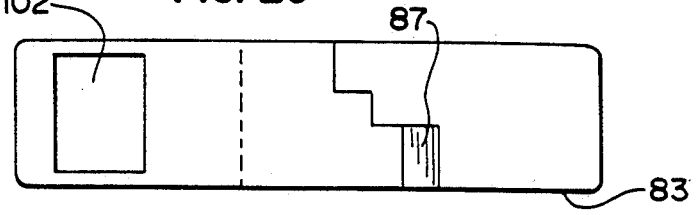
FIG. 20 is a top plan view of the transfer bar.

A transfer bar 83 is supported for sliding movement on ledges 84 in the clip housing. The transfer bar includes a rear end 85 which projects from the clip housing and a camming end 86 which includes a camming ramp 87 (see also FIG. 19). The camming ramp 87 is engageable with the angled rear portion 78 of the index lever, and sliding movement of the transfer bar to the left causes the index lever and the index pawl to rotate clockwise to rotate the loader 64.

The interaction between the point of the pawl and the ratchets 68 of the loader is conventional and need not be explained in detail. As the pawl moves upwardly, it engages one of the ratchets and rotates the loader to move one of the ammunition bores 66 into alignment with the barrel 50. As the pawl returns downwardly, it slides over the next ratchet by rotating clockwise against the force of the spring 82.

Figure 14:
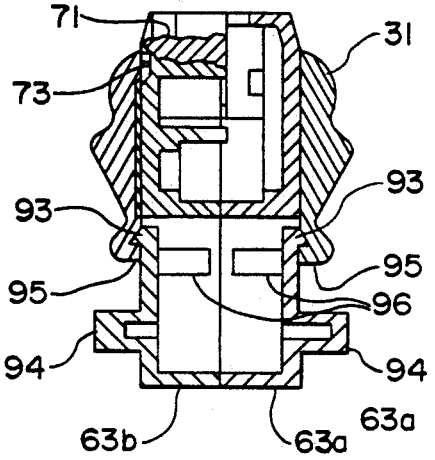
FIG. 14 is a sectional view through the clip assembly and the receiver taken along the line 14—14 of FIG. 1.
Figure 15:
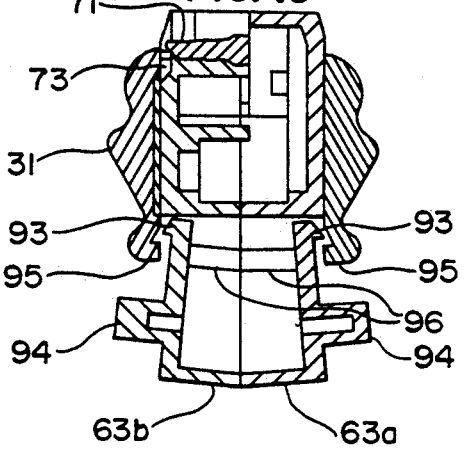
FIG. 15 is a view similar to FIG. 14 showing the latching portions of the clip housing pushed inwardly.

Each of the halves 63a and 63b of the clip housing includes a side wall 90, and a U-shaped slot 91 is formed in each side wall to provide a flexible latching portion 92. Each latching portion includes an outwardly extending ledge 93 (FIGS. 11–15) along its upper end and an outwardly extending portion 94. Referring to FIGS. 14 and 15, the clip assembly is latched into position within the receiver by the ledges 93 which engage inwardly extending tabs 95 on the receiver. The finger portions 94 project laterally outwardly below the receiver, and the clip assembly can be removed from the receiver by pushing inwardly on the finger portions as shown in FIG. 15.

An overtravel pin 96 extends laterally inwardly from each of the latching portions 92 of the clip housing. The overtravel pins are engageable when the latching portions are pushed inwardly to prevent excessive flexing of the latching portions (compare FIGS. 14 and 15).

Figure 22:
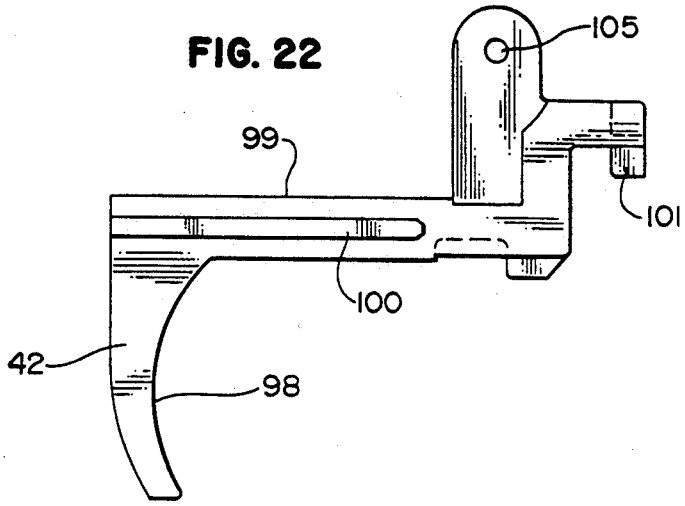
FIG. 22 is a side elevational view of the trigger.
Figure 23:
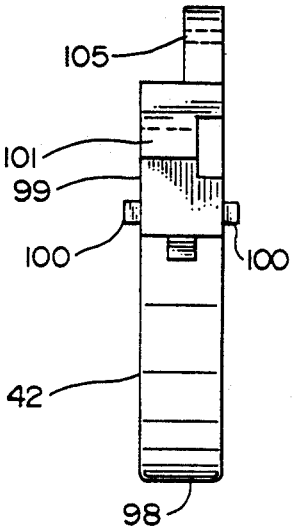
FIG. 23 is a front elevational view of the trigger.
Figure 24:
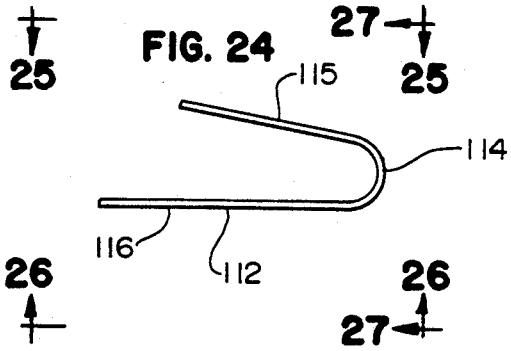
FIG. 24 is a side elevational view of the hammer latch.
Figure 25:
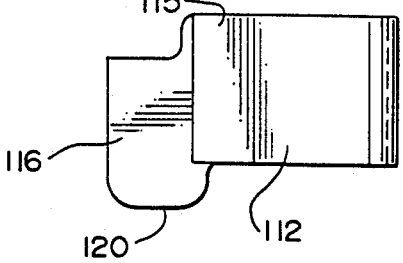
FIG. 25 is a top plan view of the hammer latch taken along the line 25—25 of FIG. 24.
Figure 26:
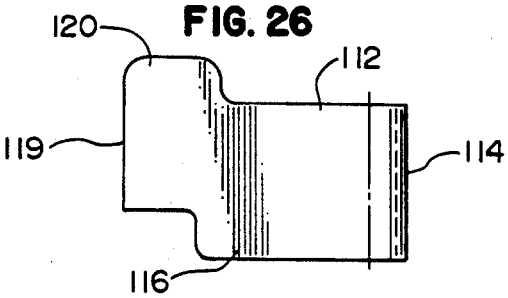
FIG. 26 is a bottom plan view of the hammer latch taken along the line 26—26 of FIG. 24.
Figure 27:
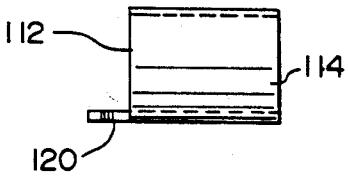
FIG. 27 is a front elevational view of the hammer latch taken along the line 27—27 of FIG. 24.

When the clip assembly is positioned in the receiver, the rear end 85 of the transfer bar 83 is engaged by the trigger 42. Referring to FIGS. 22 and 23, the trigger includes a curved finger portion 98 and a mounting portion 99. The mounting portion includes a pair of side ribs 100 which are slidably received in longitudinal recesses in the receiver for slidably supporting the trigger. The forward end of the trigger terminates in a hook 101 which is engageable with a recess 102 (FIG. 19) in the left end of the transfer bar. When the trigger is pulled to the left, the transfer bar is pulled and cams the index lever 75 to pivot clockwise, thereby rotating the loader 64. The transfer bar translates sliding movement of the trigger into rotary movement of the loader.

The trigger link 43 is pivotally connected to the trigger by a pin 104 which extends through an opening 105 (FIG. 22) in the trigger. The trigger link includes a lever portion 105 which extends behind the hook portion 101 of the trigger. A trigger spring 106 is compressed between a shoulder 107 on the receiver and the lever portion and resiliently biases the trigger link to rotate counterclockwise and resiliently biases the trigger to its forward or rest position illustrated in FIG. 1. The rear end of the trigger link is provided with a notch 108 (FIG. 6) which is engageable with a roller 109 on the hammer for cocking the hammer as the trigger is pulled. The hammer is rotatably mounted on a hammer pin 110 and is resiliently biased to rotate clockwise by a hammer spring 111.

A hammer latch 112 (FIG. 2) is engageable with a notch 113 in the hammer for preventing the hammer from contacting the valve stem 40 unless the trigger is pulled. Referring to FIGS. 24–27, the hammer latch is generally V-shaped and includes a central portion 114 and a pair of diverging legs 115 and 116. The upper leg 115 is positioned in a recess 117 (FIG. 2) in the receiver, and the hammer latch is retained in position by a pin 118. The hammer latch is formed from spring steel, and the rear edge 119 of the lower leg 116 is positioned to engage the notch 113 in the hammer. The leg 116 includes a laterally extending tab portion 120 which is engageable with a cam portion 121 on the trigger link 43 when the trigger is pulled.

Figure 5:
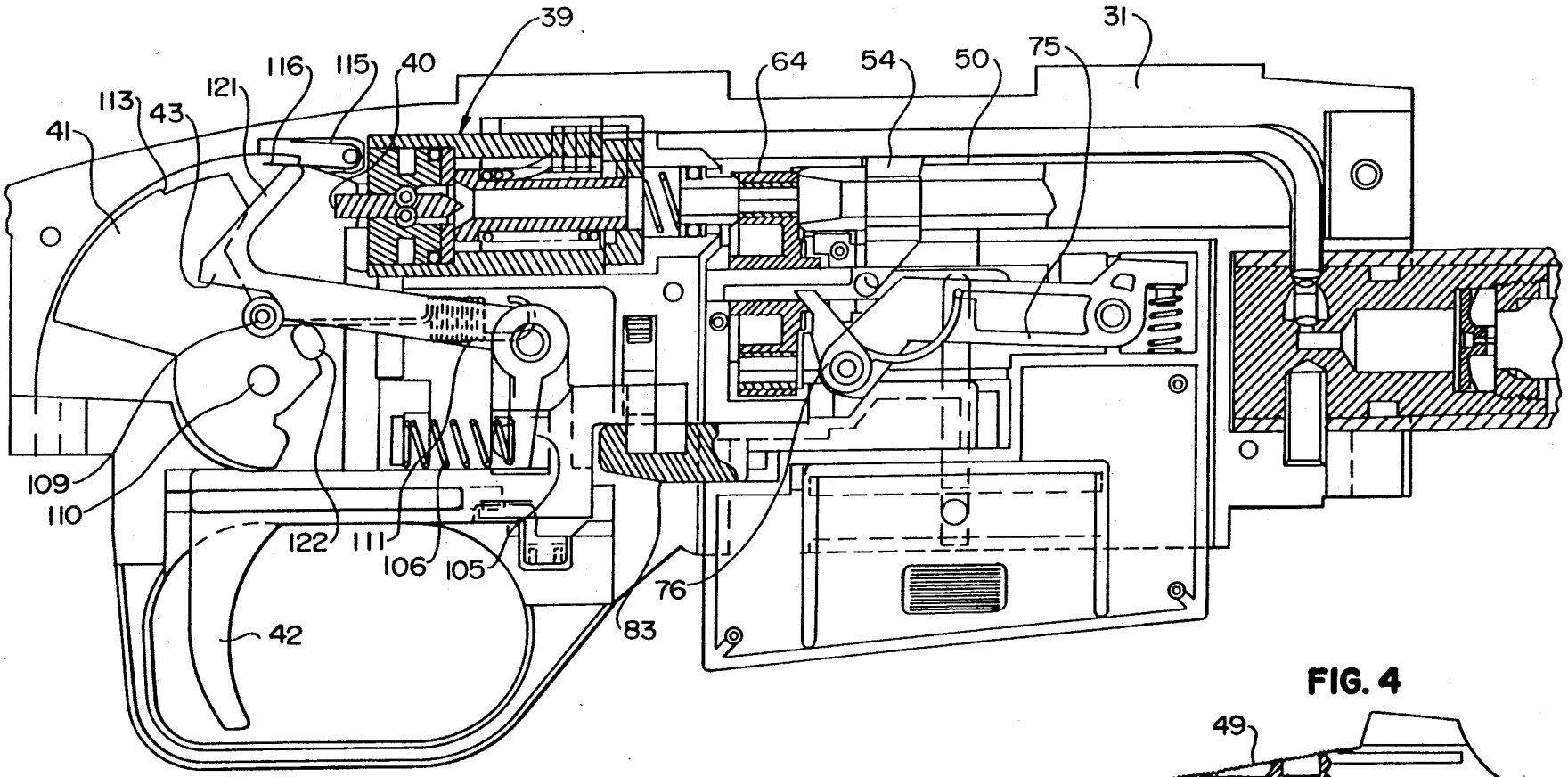
FIG. 5 is a fragmentary sectional view showing the trigger partially pulled to its firing position.
Figure 6:
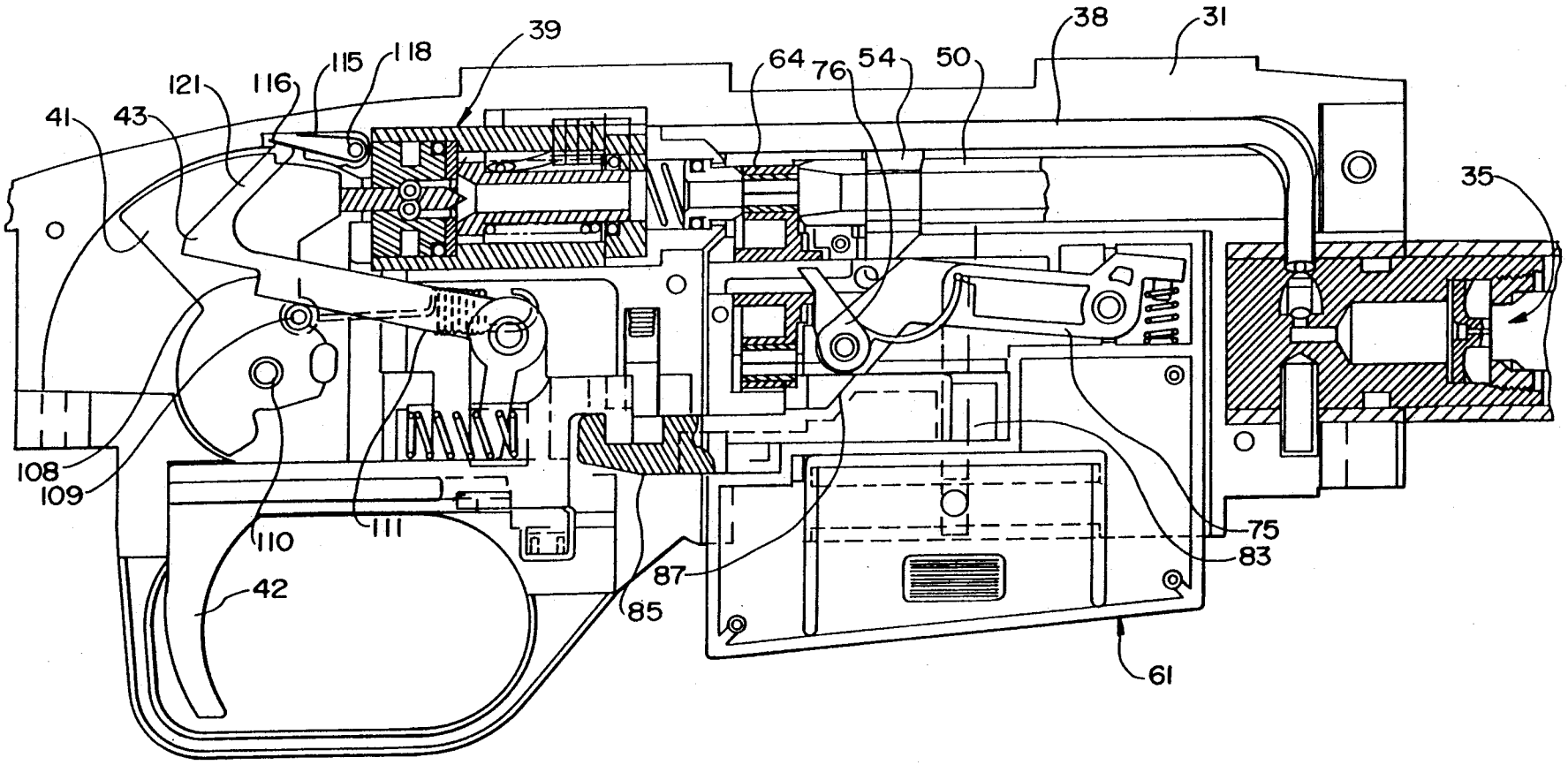
FIG. 6 is a fragmentary sectional view showing the trigger pulled to its firing position.

As the trigger is pulled rearwardly or to the left, the trigger link rotates the hammer counterclockwise as shown in FIG. 5, and the cam portion 121 engages the tab 120 and pushes the lower leg 116 of the hammer latch upwardly. As the trigger is pulled farther, a cam 122 on the hammer engages the trigger link and lifts the notch 108 of the trigger link out of engagement with the roller 109. The hammer is then pulled by the hammer spring 111 to the fired position of FIG. 6 in which it strikes the valve stem 40 and releases the gas charge within the valve assembly 39. The lower leg 116 of the hammer latch 112 is maintained out of engagement with the hammer by the trigger link 43.

If the hammer is rotated clockwise and then released without pulling the trigger, the hammer latch 112 will engage the hammer and prevent the hammer from contacting the valve stem 40, thereby preventing an accidental discharge.

The hammer latch eliminates the need for a transfer link which is normally positioned between the hammer and the valve stem as described, for example, in application Ser. No. 737,209. A transfer link creates an energy loss between the hammer and the valve stem, and eliminating the transfer link allows use of a lighter hammer spring, which permits a lighter trigger pull.

In FIG. 1 the clip assembly 61 is positioned within the receiver. The rear end of the barrel 50 abuts the loader 64 and is aligned with one of the projectile bores in the loader. A spring-biased detent tube 124 extends into the projectile bore which is aligned with the barrel.

FIG. 3 illustrates a pellet 125 in a typical jammed position in which the pellet extends partiallly out of the loader 64. In preparation for removal of the clip assembly, the barrel 50 has been moved forwardly by depressing the finger tab portions 56 of the barrel latch 54 and moving them forwardly within the slots 58 (FIG. 10) in the sides of the receiver. In the forward position of the barrel latch the safety tab 57 on the barrel latch extends through an opening 126 (FIG. 12) in the top of the clip housing and engages the indexing lever 75. The safety tab prevents clockwise pivoting of the lever, and the trigger therefore cannot be pulled when the barrel is in its forward position.

With the barrel in its forward position, the clip assembly can be removed from the receiver by pressing the finger projections 94 on the latching portions 92 of the clip housing inwardly as illustrated in FIG. 15 so that the ledges 93 on the latching portions clear the tabs 95 on the receiver. The clip assembly can then be pulled downwardly out of the receiver. The jammed pellet 125 is removed from the receiver with the clip assembly.

If a pellet is jammed in the barrel rather than the loader, the clip assembly is removed and the pellet is pushed into the recess 62 in the receiver.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A gun comprising:

a frame, an elongated barrel slidably mounted on the frame for movement in a longitudinal direction, a clip assembly removably mounted on the frame, the clip assembly including a housing and loader means on the housing for positioning a projectile in alignment with the barrel, the frame including a recess in which the clip housing is mounted, the clip housing including a pair of spaced-apart side walls, each of the side walls being provided with a slot to provide a flexible latch portion on the side wall, the latch portion of each of the side walls being releasably engageable with the frame for retaining the clip housing in the recess.

2. The gun of claim 1 in which the latch portions of each of the side walls of the clip housing includes an overtravel pin which extends toward the other side walls, the overtravel pin being engageable when the latch portions are flexed toward each other for preventing excessive flexing of the latch portions.

3. The gun of claim 2 in which the frame includes a pair of side walls which provide said recess, the latch portions of the side walls of the clip housing extending below the side walls of the frame when the clip assembly is retained within the recess, each of the latch portions including a laterally outwardly extending finger portion which extends laterally outwardly below the side walls of the frame.

4. A gun comprising:

a frame, an elongated barrel slidably mounted on the frame for movement in a longitudinal direction, a clip assembly removably mounted on the frame, the clip assembly including a housing and loader means on the housing for positioning a projectile in alignment with the barrel, a hammer pivotally mounted on the frame for movement between a cocked position and a firing position, link means operatively associated with the trigger and the hammer for moving the hammer to the cocked position as the trigger is moved to the firing position and for releasing the hammer when the trigger reaches the firing position, a hammer latch on the frame for movement between a latching position and an unlatching position, the hammer latch in the latching position being engageable with the hammer for preventing the hammer from reaching the fired position unless the trigger is pulled, the hammer latch being engageable by the link means for movement to the unlatching position as the trigger is moved to the firing position.

5. The gun of claim 4 in which the hammer latch is formed from spring metal and includes a pair of diverging legs, one of the legs engaging the frame and the other leg being engageable with the hammer when the hammer latch is in its latching position, said other leg being engageable by said link means.

6. The gun of claim 5 in which said other leg includes a tab portion which is engageable by said link means.

7. The gun of claim 6 in which said link means comprises an elongated link pivotally attached to the trigger, the link including a cam portion which is engageable with the tab portion of the hammer latch.

8. A gun comprising:

a frame, an elongated barrel mounted on the frame, a trigger mounted on the frame for movement between a rest position and a firing position, a hammer mounted on the frame for movement between a cocked position and a fired position, and a clip assembly removably mounted on the frame, the clip assembly including:

a clip housing, a cylindrical loader rotatably mounted on the clip housing for rotation about an axis which extends parallel to the longitudinal axis of the barrel, the loader having a plurality of openings for retaining projectiles, a lever pivotally mounted on the clip housing and a pawl pivotally mounted on the lever, the pawl being engageable with the loader for rotating the loader as the lever pivots in one direction, and transfer means movably mounted on the clip housing and engageable with the lever for moving the lever in said one direction, said transfer means being engageable with the trigger when the clip assembly is mounted in the frame for transferring movement of the trigger to movement of the lever.

9. The gun of claim 8 in which the transfer means comprises an elongated bar which is slidably mounted in the clip housing for movement in a direction parallel to the longitudinal dimension of the barrel, the bar including a cam which is engageable with the lever for pivoting the lever in said one direction when the trigger is pulled.

10. A gun comprising:

a frame, an elongated barrel slidably mounted on the frame for movement in a longitudinal direction, a trigger mounted on the frame for movement between a rest position and a firing position, a clip assembly removably mounted on the frame, the clip assembly including:

a clip housing, means for removably attaching the clip housing to the frame, a cylindrical loader rotatably mounted on the clip housing for rotation about an axis which extends parallel to the longitudinal axis of the barrel, the loader having a plurality of openings for retaining projectiles, rotating means movably mounted on the clip housing for rotating the loader, and transfer means movably mounted on the clip housing and operatively associated with the rotating means whereby movement of the transfer means moves the rotating means to rotate the loader, the transfer means being engageable with the trigger when the clip assembly is mounted in the frame for transferring movement of the trigger to movement of the loader.

11. The gun of claim 10 including a barrel latch engaging the barrel and having a tab portion extending through the frame whereby the barrel can be moved longitudinally by moving the tab portion.

12. The gun of claim 2 in which the frame is provided with a slot through which the tab extends, the slot having a latching portion and a longitudinally extending portion which extends parallel to the longitudinal dimension of the barrel.

13. The gun of claim 10 in which the clip assembly includes a loader pin which extends slidably through the center of the cylindrical loader and is slidably mounted on the clip housing, the loader pin rotatably supporting the cylindrical loader whereby the loader can be removed from the clip housing when the clip assembly is removed from the frame by sliding the loader pin out of the center of the loader.

14. The gun of claim 13 in which the clip housing includes detent means for engaging and releasably retaining the loader pin when the loader pin and loader are mounted on the clip housing.

15. The gun of claim 10 in which the rotating means includes indexing means on the clip housing for rotating the loader to align one of the openings in the loader with the barrel.

16. The gun of claim 15 in which the indexing means includes a lever pivotally mounted on the clip housing and a pawl pivotally mounted on the lever, the pawl being engageable with the loader for rotating the loader as the lever pivots in one direction.

17. The gun of claim 16 in which the clip assembly includes a cam which is slidably mounted on the clip housing for movement in a direction parallel to the longitudinal dimension of the barrel, the cam being engageable with the lever for pivoting the lever in said one direction, the gun including a trigger mounted on the frame for movement between a rest position and a firing position, the trigger being engageable with the cam when the clip assembly is mounted in the frame whereby movement of the trigger from the rest position to the firing position will move the can and pivot the lever in said one direction.

18. The gun of claim 16 including a barrel latch engaging the barrel and having a tab portion extending through the frame, the barrel latch being movable between first and second positions for moving the barrel longitudinally, the barrel latch being engageable by the lever when the barrel latch is in the second position for preventing pivoting movement of the lever.

* * * * *

UNITED STATES PATENT AND TRADEMARK OFFICE

CERTIFICATE OF CORRECTION

PATENT NO. : 5,285,766

DATED : February 15, 1994

INVENTOR(S) : Keith L. Milliman

It is certified that error appears in the above-indentified patent and that said Letters Patent is hereby corrected as shown below:

Col. 8, line 9 change "2" to --11-- and in line 45, change "can" to --cam--.

Signed and Sealed this

Twelfth Day of July, 1994

Bruce Lehman

*Attest:*

BRUCE LEHMAN

*Attesting Officer*

*Commissioner of Patents and Trademarks*